US008800744B2

(12) United States Patent
Illedits et al.

(10) Patent No.: US 8,800,744 B2
(45) Date of Patent: Aug. 12, 2014

(54) HANDRAIL FOR AN ESCALATOR OR A MOVING WALKWAY

(75) Inventors: Thomas Illedits, Österreich (AT); Thomas Novacek, Österreich (AT); Michael Matheisl, Österreich (AT)

(73) Assignee: Inventio AG, Hergiswil NW (CH)

( * ) Notice: Subject to any disclaimer, the term of this patent is extended or adjusted under 35 U.S.C. 154(b) by 291 days.

(21) Appl. No.: 12/993,535

(22) PCT Filed: May 5, 2009

(86) PCT No.: PCT/EP2009/055428
§ 371 (c)(1),
(2), (4) Date: Nov. 19, 2010

(87) PCT Pub. No.: WO2009/141224
PCT Pub. Date: Nov. 26, 2009

(65) Prior Publication Data

US 2011/0083938 A1 Apr. 14, 2011

(30) Foreign Application Priority Data

May 21, 2008 (EP) ..... 08156616

(51) Int. Cl.
*B66B 23/22* (2006.01)
*B66B 23/24* (2006.01)

(52) U.S. Cl.
CPC ..... *B66B 23/24* (2013.01)
USPC ..... 198/337

(58) Field of Classification Search
CPC ..... B66B 23/24
USPC ..... 198/337
See application file for complete search history.

(56) References Cited

U.S. PATENT DOCUMENTS

| | | | | | |
|---|---|---|---|---|---|
| 2,766,868 | A | * | 10/1956 | Tilton | 198/337 |
| 3,442,367 | A | * | 5/1969 | Voorhis | 198/335 |
| 3,688,889 | A | * | 9/1972 | Ernst Koch et al. | 198/337 |
| 3,778,882 | A | * | 12/1973 | Cameron et al. | 29/450 |
| 3,865,225 | A | * | 2/1975 | Phal | 198/337 |
| 5,160,009 | A | * | 11/1992 | Iyoda et al. | 198/337 |
| 5,566,810 | A | * | 10/1996 | Meyer et al. | 198/331 |

(Continued)

FOREIGN PATENT DOCUMENTS

| | | |
|---|---|---|
| DE | 24 60 423 | 12/1974 |
| DE | 103 16 383 A1 | 11/2004 |

(Continued)

*Primary Examiner* — James R Bidwell
(74) *Attorney, Agent, or Firm* — Ladas & Parry LLP

(57) ABSTRACT

The invention relates to a handrail (1), used in particular for escalators or moving walkways, comprising a plurality of grip elements (10) or grip segments (10) arranged next to one another. The grip elements or grip segments (10) consist of a base body (11) that has an outer shell (12) or cover layer (12) and several inner chambers (15) delimited by the outer shell (12) or cover layer (12). The base body (11) has many or several reinforcing ribs (16 to 20 and 16' to 20', 35 and 35' and 36 and 54). The outer shell or cover layer (12) is continuous in a grip region (13). The reinforcing ribs (16 to 20 and 16' to 20', 35 and 35' and 36 and 54) divide the interior (15) into separate, independent chambers (21-24, 37-38, 55). This provides excellent thermal insulation and excellent soundproofing or noise insulation.

12 Claims, 6 Drawing Sheets

(56) References Cited

U.S. PATENT DOCUMENTS

| | | | | |
|---|---|---|---|---|
| 6,382,389 | B1 * | 5/2002 | Mehlert et al. | 198/335 |
| 6,866,125 | B2 * | 3/2005 | Ball et al. | 187/391 |
| 7,614,490 | B2 * | 11/2009 | Milton-Benoit et al. | 198/337 |
| 2002/0084169 | A1 * | 7/2002 | Schulte et al. | 198/337 |
| 2006/0237284 | A1 * | 10/2006 | Miessbacher | 198/336 |
| 2006/0260906 | A1 | 11/2006 | Novacek et al. | |

FOREIGN PATENT DOCUMENTS

| | | | | |
|---|---|---|---|---|
| WO | WO 91/04219 | | 4/1991 | |
| WO | WO 2006029706 | A1 * | 3/2006 | B66B 23/14 |
| WO | WO 2007/055693 | | 5/2007 | |

* cited by examiner

HANDRAIL FOR AN ESCALATOR OR A MOVING WALKWAY

TECHNICAL FIELD

The invention relates to a handrail, particularly a handrail for escalators or moving walkways. Specifically, the invention relates to the field of handrails for escalators or moving walkways in which the handrail is driven by means of a chain or a belt or the like.

BACKGROUND OF THE INVENTION

A device for guiding a multi-element handrail and a multi-element, drivable handrail are known from DE 103 16 383 B4. The known handrail includes a base body, which co-operates with a guide profile member, and a plurality of individual elements, wherein the base body is provided with several outwardly facing elements of web-like construction and the individual members are disposed in operative connection with one another. In that case the elements are provided in their inner regions remote from the webs with projections by way of which a mechanically positive connection with a drive chain can be produced.

The handrail known from DE 103 16 383 B4 has the disadvantage that water and contaminants can collect at the large surface. Moreover, during operation of the device for guidance of the multi-element handrail, noise, which is undesired, arises as a consequence of the permeable, soft outer shell or cover layer or casing thereof when the handrail is driven.

The object of the invention is to create a handrail which has an improved outer surface or outer shell or cover layer or casing and is universally usable as far as possible.

BRIEF DESCRIPTION OF THE INVENTION

Through the outer shell or cover layer or casing, which is designed to be closed, in the grip region there is, in particular, the advantage that the surface at which dirt or water can collect is reduced and simple cleaning is made possible. Moreover, due to the mutually separate chambers provided in the interior space an improved thermal insulation and/or noise or sound damping can be achieved. It is thereby possible to so design the handrail that, for example, in the case of installation outside, freezing or sticking of the handrail on a corresponding handrail guide is prevented or at least the risk of such freezing is reduced. In addition, optimisation with respect to the occurrence of vibration and noise, i.e. damping and/or insulating, can also take place in advantageous manner.

It is advantageous if at least one bearing pin or mount or recess, which is arranged in the interior space of the base body and serves as a bearing location, is provided. In that case it is further advantageous that the bearing pin or mount or recess is oriented towards an opening provided in the outer shell or cover layer or casing. This makes possible a simple mounting of the grip elements or grip segments on a traction means, particularly a chain or a belt. The grip elements or grip segments can then, for example, be placed on the chain or the belt and clipped in place by means of the bearing pin or mount or recess in the grip element or grip segment. A simple mounting of the handrail is thus possible, wherein optionally also demounting of individual elements at a desired or intended location can be carried out in simple manner, for example within the scope of repair or maintenance or inspection or visual checking.

Moreover, it is advantageous if the bearing pin or mount is connected with the outer shell or cover layer or casing by means of one or more stiffening ribs. The bearing location formed is in that case preferably provided substantially in a centre of the base body of the grip element or grip segment. This has the advantage that a symmetrical pull of the traction means on the grip element or grip segment takes place, whereby a possible tilting moment is reduced. Moreover, a high degree of bending stiffness can be guaranteed, since due to the stiffening ribs a fastening, which is stiff in bending, of the bearing pin or mount or recess is possible. Moreover, there is the advantage that the outer shell or cover layer or casing is largely relieved of traction forces or bending moments transmitted by the traction means, so that the geometry and dimensions of the outer shell or cover layer or casing can be fixed independently. For example, the outer shell or cover layer or casing can be formed from an advantageously thin material.

It is also advantageous if one or more bearing recesses serving as bearing location or mounting location is or are provided at at least one reinforcing rib. In that case, an elongated bolt of a transport chain or chain or a belt or the like can engage in such a bearing recess. This enables adaptation to traction means of different design. Moreover, different fastening concepts can be realised depending on the respective application.

In advantageous manner the stiffening ribs form lateral guide grooves which face one another. The lateral guide grooves serve for mounting on a handrail guide profile member which is provided at least in sections. Such a handrail guide profile member can be formed from, for example, steel or stainless steel or a plastics material or a material composite. In that case it is advantageous that the lateral guide grooves do not connect directly with the outer shell or cover layer or casing, but are spaced therefrom by one or more chambers. Noise insulation or sound insulation can thereby be achieved. Moreover, a higher degree of stiffening or reinforcing can be achieved, whereby any vibrations or oscillations that occur are not passed on or are passed on only in reduced form to the outer shell or cover layer.

In advantageous manner at least one guide flute oriented in running direction is provided at an outer side of the outer shell or cover layer. In the mounted state the guide flute during return transport can be supported in a lower section of the handrail by one or more guide roller arrangements. The return transport can thereby even take place without a handrail guide profile member. As a consequence, the wear or abrasion in the region of the lateral guides or guide grooves certainly noticeably reduces in the region of the lateral guides or guide grooves. A function-impairing wear during operation of the escalator or moving walkway is thus inhibited or prevented or is very small or reduced.

Moreover, it is advantageous that the guide flute extends, for the return transport, in a section of the outer shell or cover layer which forms an outer wall for chambers separated from one another by the stiffening ribs in the interior space. A certain degree of elasticity of the section of the outer shell or the cover layer, in which the guide groove runs for the return transport, can thereby be achieved, so that a degree of damping of shocks or shaking is achieved.

In advantageous manner the outer shell or cover layer is formed by an oval or elliptical cross-section which enables a pleasant, hand-friendly gripping of the handrail.

Moreover, it is advantageous if the outer shell or cover layer has a cross-section which is composed at least in the grip region of a small and a large oval or elliptical contour, wherein the smaller oval or elliptical contour is cut at one side of the large oval or elliptical contour by the large oval or elliptical contour. In the mounted state the small oval or elliptical contour faces the standing region or inner region of the escalator or the moving walkway. This embodiment has the advantage that different grip possibilities or handgrip possibilities are made possible. Specifically, the large oval or elliptical contour makes possible secure gripping or holding from above by adults and the small oval or elliptical contour enables gripping from below or from the side or from the inner side. Children and young people can thereby securely hold the handrail.

It is advantageous if the base body is of integral or multipart construction. Moreover, it is advantageous if the base body is formed by an injection-moulded part or a press-moulded part or a cast part or an extruded part or a pultrusion part or a diecast part. This production method makes possible economic production of the grip elements or grip segments in large batch numbers.

Reference is expressly made to a possible capability of combining the teaching of this application with the teaching of an application filed at the same time by the same applicant. A handrail with material properties and safety characteristics improved even further or to greater extent, or more or multiply improved, are disclosed there.

In a further preferred embodiment of the invention the following modifications, which are advantageous individually or in combination with the other aspects of the invention, are provided:

- the outer shell of the handrail has an at least substantially oval or elliptical cross-section at least in the grip region;
- the base body of the handrail is of integral or multi-part and/or multi-piece construction;
- the base body of the handrail is formed by at least one injection-moulded part and/or by at least one press-moulded part and/or at least one cast part and/or at least one diecast part and/or at least one extruded part and/or at least one pultrusion part;
- the grip element of the handrail lies, in length or width, of the handrail in the range between 40 and 78 mm, preferably between 70 and 75 mm;
- the grip element of the handrail lies in a height in the range of 34 to 70 mm, preferably between 35 and 62 mm;
- the grip element of the handrail has an oval or elliptical cross-section with the dimensions 70 to 40 mm length and 40 to 60 mm height.

BRIEF DESCRIPTION OF THE DRAWINGS

The invention is explained in more detail symbolically and by way of example on the basis of the figures.

The figures are described conjunctively and generally. The same reference numerals signify the same components. Reference numerals with different indices indicate functionally equivalent or similar components.

Preferred embodiments of the invention are explained in more detail in the following description by way of the accompanying drawings, in which corresponding elements are provided with corresponding reference numerals and in which:

FIG. 1 shows a schematic illustration of a mounted handrail in correspondence with one possible embodiment of the invention;

FIG. 2 shows a grip element or grip segment of the handrail shown in FIG. 1 in correspondence with a first embodiment of the invention;

FIG. 3 shows the grip element or grip segment, which is shown in FIG. 2, in correspondence with a second embodiment of the invention;

FIG. 4 shows the grip element or grip segment, which is shown in FIG. 2, from the viewing direction denoted by IV and in correspondence with a third embodiment of the invention;

FIG. 5 shows an illustration, in the manner of a detail, of the grip element or grip segment shown in FIG. 2, in correspondence with a fourth embodiment of the invention;

FIG. 6 shows two grip elements or grip segments, which are assembled in correspondence with a mounted state, for further explanation of the invention;

FIG. 7 shows the grip element or grip segment, which is shown in FIG. 2, from the viewing direction denoted by IV and in correspondence with a fifth embodiment of the invention;

FIG. 8 shows a grip element or grip segment in a preferred form of embodiment with additional chambers; and FIG. 9 shows a grip element or grip segment in a construction with an additional small oval or elliptical contour plus enlarged additional chambers for insulation or damping.

DETAILED DESCRIPTION OF PREFERRED EMBODIMENTS

Figure 1:
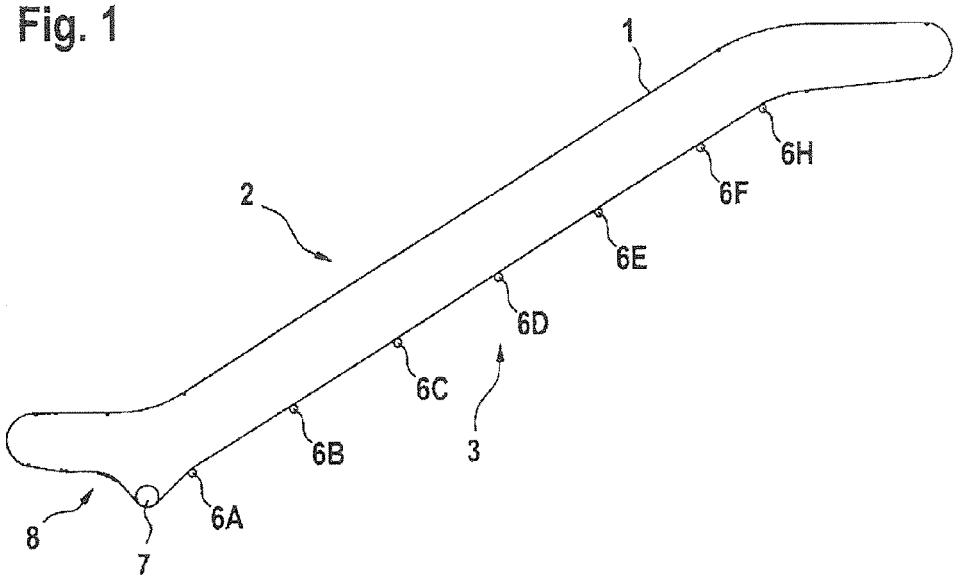
Figure 7:
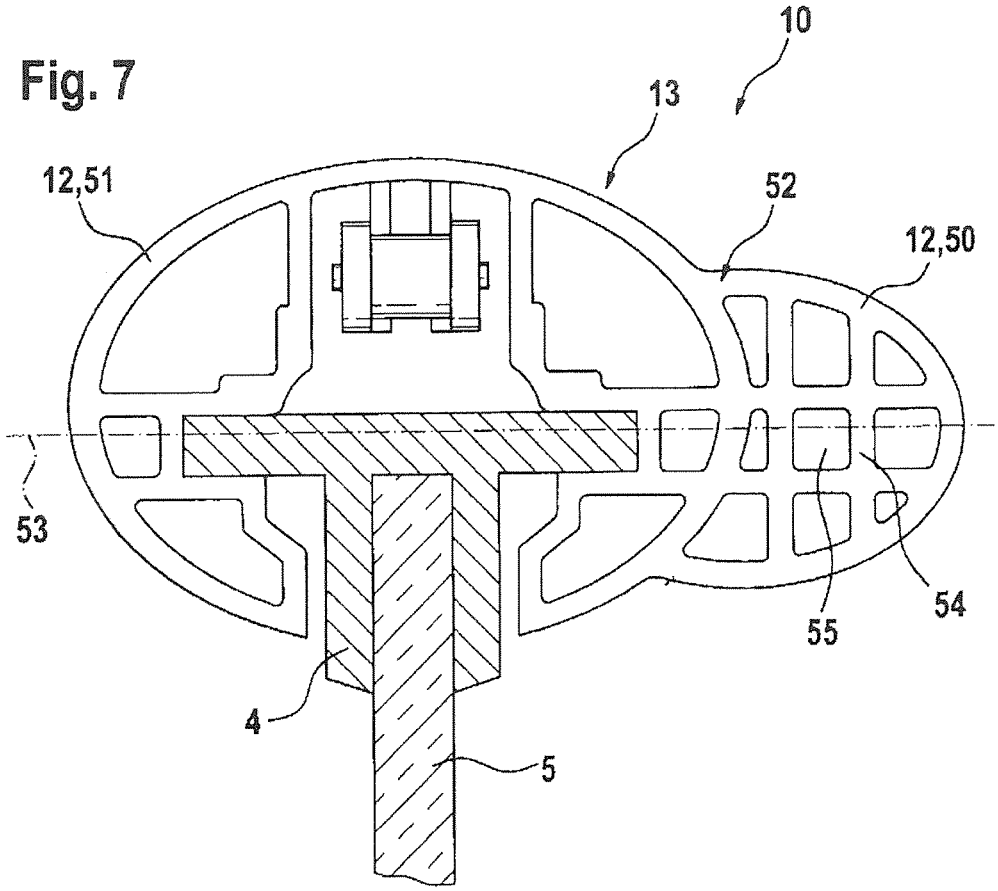

FIG. 1 shows a schematic illustration of a handrail 1 for an escalator or a moving walkway in correspondence with one possible embodiment of the invention. The handrail 1 has an upper region 2 or forward run 2 and a lower region 3 or return run 3. Provided in the upper region 2 or forward run 2 is a handrail guide profile member 4 which is fastened on a balustrade 5 as is illustrated in FIG. 7. No handrail guide profile member 4 for guidance or return guidance is provided in the lower region 3 or return run 3. Guidance of the handrail 1 takes place in the lower region 3 or return run 3 only by way of the rollers or roller arrangements 6A-6H. In addition, a drive 7 and a tensioning roller system 8 are provided. The handrail 1 of the invention is particularly suitable, in the illustrated arrangement, for an escalator. Use of the handrail 1 according to the invention in a moving walkway is also given. In that case, simple mounting and simple exchange of individual parts and/or simplified, economic maintenance is or are made possible. However, the handrail 1 is also suitable for other applications, particularly for moving walkways.

Figure 2:
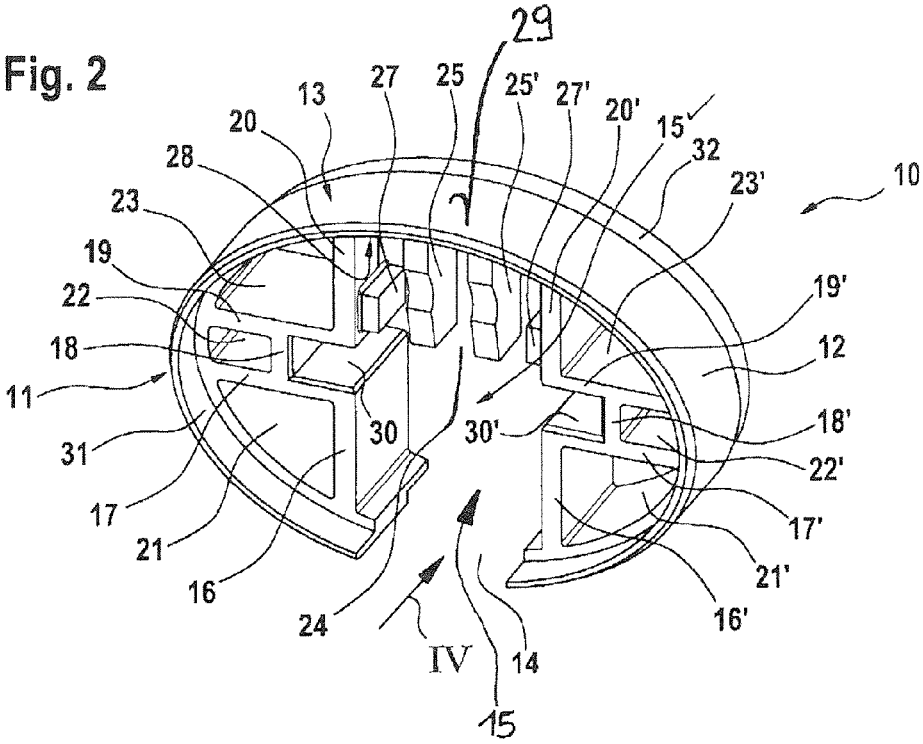

FIG. 2 shows a grip element or grip segment 10 of the handrail 1 of an escalator or a moving walkway in a perspective illustration in correspondence with a first exemplifying embodiment of the invention. The handrail 1 illustrated in FIG. 1 is in that case composed of a plurality of such grip elements or grip segments 10, wherein in the mounted state an endless annular arrangement of the grip elements or grip segments 10 for formation of the handrail 1 results.

The grip element 10 or grip segment 10 has a base body 11 with an outer shell 12 or cover layer 12. In that case, the outer shell 12 or cover layer 12 is formed with an oval or elliptical cross-section. The outer shell 12 or cover layer 12 is formed to be closed in a grip region 13. Moreover, the outer shell 12 or cover layer 12 has an opening 14. The base body 11 has an interior space 15 which is bounded by the outer shell 12 or the cover layer 12. Several stiffening ribs 16, 17, 18, 19, 20, 16', 17', 18', 19', 20' are arranged in the interior space 15 of the base body 11. The stiffening ribs 16 to 20 and 16' to 20' form several chambers or cavities or depressions or pockets or recesses or blind holes 21, 22, 23, 21', 22', 23', which subdivide or delimit the interior space 15. For example, the stiffening ribs 16, 17 separate off the chamber 21 of the interior space 15. The chamber 21 is in that case bounded and surrounded by the stiffening ribs 16, 17 and the outer shell 12 or cover layer 12.

Additional or improved or a perfected or developed thermal insulation and sound damping or sound insulation is achieved by the chambers 21 to 23 and 21' to 23'.

Bearing pins 25, 25' or mounts 25, 25' or recesses 25, 25' forming a bearing location or mounting location are arranged in a remaining chamber 24 or main chamber 24 or large chamber 24, which is also opened at the outer shell 12 or cover layer 12 by the opening 14. During mounting of the grip element or grip segment 10 it is possible for the grip element 10 or grip segment 10 to be placed by way of the opening 14 on a chain or a belt. The grip element 10 or grip segment 10 is then positioned so that the bearing pins 25, 25' or mounts 25, 25' or recesses 25, 25' engage or detent in a chain element 26 (FIG. 4) of the traction means or the chain. In addition, elements 27, 27' or support elements 27, 27' or guide elements 27, 27' are provided laterally of the guide pins 25, 25' or mounts 25, 25' or recesses 25, 25' at the stiffening ribs 20, 20', which serve for stabilisation or support or guidance of the chain element 26.

The stiffening ribs 17, 18, 19 form a first, lateral guide groove 30. The stiffening ribs 17', 18', 19' form a second, lateral guide groove 30'. The two lateral guide grooves 30, 30' are provided for the handrail guide profile member 4. Moreover, the two lateral guide grooves 30, 30' face one another in mirror image. The lateral guide grooves 30, 30' serve, as already explained, for reception of the handrail guide profile member 4 in order to make possible guidance of the grip element 10 or grip segment 10 on the handrail guide profile member 4 in the upper region 2 or forward run 2. Guidance of the grip element 10 or grip segment 10 is thereby guaranteed, wherein supporting forces and holding forces, which are transmitted by way of the outer shell 12 or cover layer 12 to the base body 11, of a person are absorbed.

The lateral guide grooves 30, 30' are separated by the chambers 21, 22, 23 or the chambers 21', 22', 23' from the outer shell 12 or cover layer 12 so that a noise damping or noise insulation results. In addition, reinforcing or stiffening or strengthening is guaranteed by the stiffening ribs 16 to 20 and 16' to 20', which reduce transmission of vibrations or shaking to the outer shell 12 or cover layer 12. Moreover, a thermal insulation is produced by the chambers 21 to 23 and 21' to 23', which prevent freezing of the grip element 10 or grip segment 10 on the handrail guide profile member. In addition, the risk of such freezing is substantially or largely reduced by further additional chambers as in FIGS. 8 and 9.

The grip element 10 or grip segment 10 has, at one side. an encircling, inwardly disposed recess 31 or bevel 31 at the outer shell 12 or cover layer 12 and an encircling, outwardly disposed recess 32 or bevel 32 of the outer shell 12 or cover layer 12 at an opposite side. In that case the constructions or designs of the recesses 31, 32 are matched to one another. On assembly of the handrail 1 the inwardly disposed recess 31 co-operates with the outwardly disposed recess 32' of a succeeding or adjacent grip element 10' or grip segment 10', as is illustrated or shown in FIG. 6.

In the case of the grip element 10 or grip segment 10 illustrated in FIG. 2 the bearing pins 25, 25' or mounts 25, 25' or recesses 25, 25' are fastened to an inner side 28 of the outer shell 12 of the cover layer 12. The bearing pins 25, 25' or mounts 25, 25' or recesses 25, 25' are thus directly connected with the outer shell 12 or cover layer 12 or mounted thereat. Embodiments with bearing pin connections at the stiffening ribs 16, 17, 18, 19, 20 are also conceivable.

Figure 3:
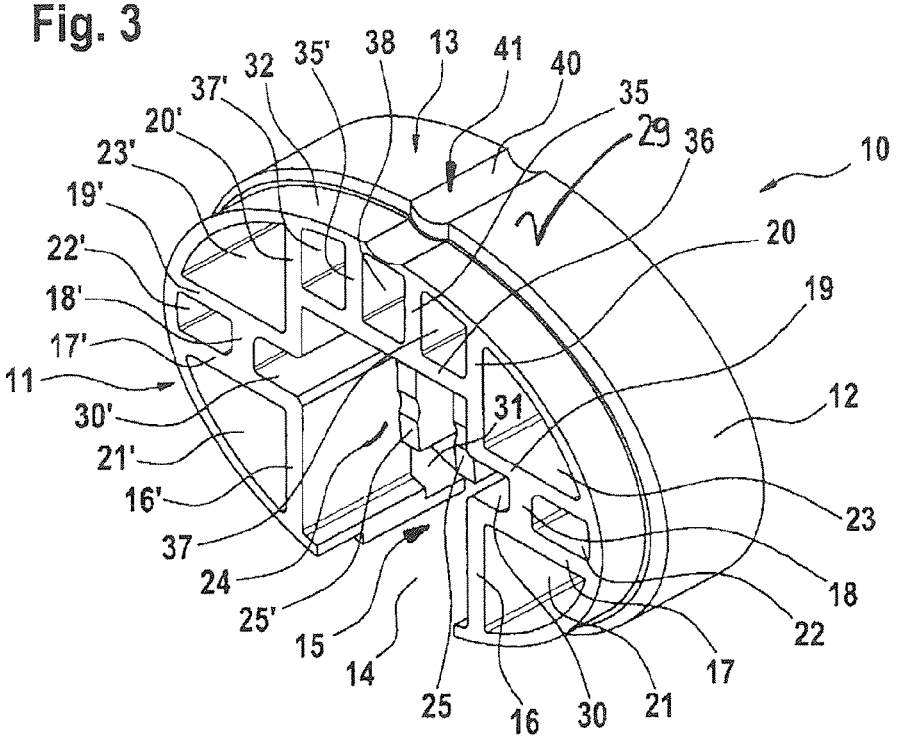

FIG. 3 shows a grip element 10 or grip segment 10 in a perspective illustration in correspondence with a second exemplifying embodiment of the invention. In this exemplifying embodiment further stiffening ribs 35, 36 and 35' are provided. In that case the stiffening ribs 35 and 35' are coupled or connected with the outer shell 12 or cover layer 12 of the base body 11. The stiffening ribs 20, 35 and 36 as well as 20', 35' form or shape the three chambers 37, 38. The bearing pins 25 and 25' or mounts 25 and 25' or recesses 25 and 25' are consequently connected uprightly, straight, vertically, perpendicularly or directly with the reinforcing rib 36, wherein the reinforcing rib 36 is decoupled from or not connected with the outer shell 12 or cover layer 12. The bearing pins 25 and 25' or mounts 25 and 25' or recesses 25 and 25' are thus separated from the outer shell 12 or cover layer 12 by the three chambers 37, 38 and 37'. The noise insulation is thereby markedly or noticeably or significantly improved. In addition, by virtue of the traction means, i.e. the chain or the belt, shaking exerted on the bearing pins 25 and 25' or mounts 25 and 25' or recesses 25 and 25' is not transmitted, or is transmitted only with substantial damping, to the outer shell 12 or cover layer 12. Moreover, due to the chambers 37, 38 and 37' the thermal damping and insulation and noise damping were further improved or additionally perfected by comparison with the exemplifying embodiment described in the embodiment of FIG. 2. A further advantage consists in that the mounting locations or bearing locations provided by the bearing pins 25 and 25' or mounts 25 and 25' or recesses 25 and 25' are arranged at least approximately in the centre of the base body 11 of the grip element 10 or grip segment 10. Guidance and sliding on the handrail profile member 4 are thereby improved. Moreover, the tilting moment is reduced. Further, the stiffness in bending of the base body 11 is further increased and multiply enhanced by the reinforcing ribs 35, 36 and 35'.

A guide flute 40 or guide groove 40 which is directed or oriented in the running direction is provided at the outer shell 12 or cover layer 12 in the centre of the grip region 13. The running direction is in that case the same as the direction denoted in FIG. 2 by IV. The guide flute 14 or guide channel 40 extends in a section 41 of the outer shell 12 or cover layer 12, which forms an outer wall or top or top wail or upper boundary for the chamber 38.

In the exemplifying embodiment illustrated in FIG. 3 the guide flute 40 or guide groove 40 is provided in the grip region 13 at an outer side 29 or upper side 29 or top side 29 of the outer shell 12 or cover layer 12.

Figure 4:
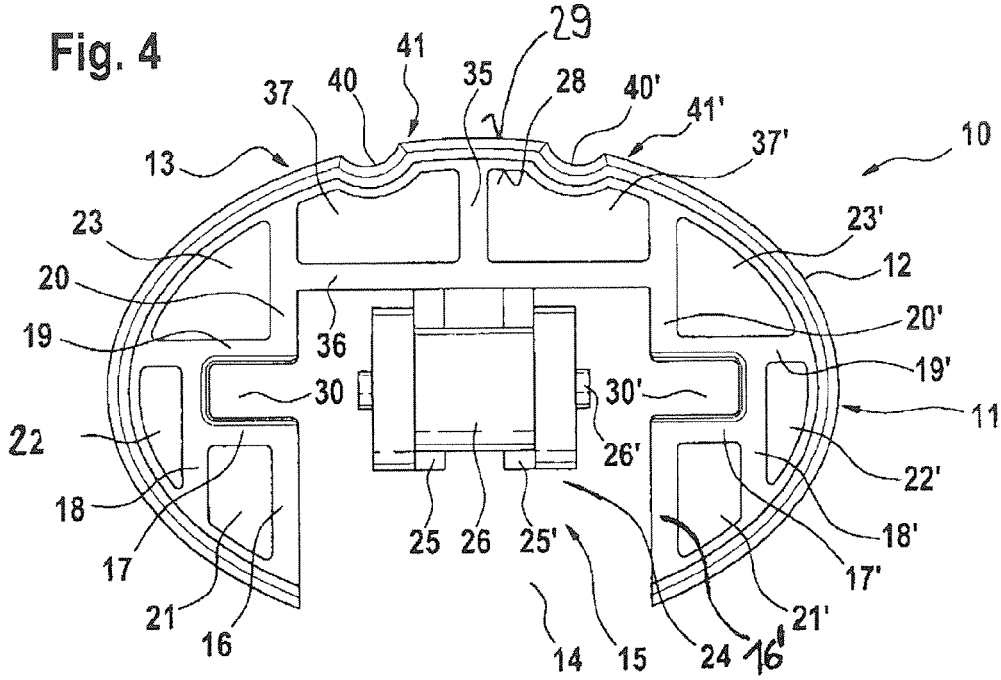

FIG. 4 shows the grip element or grip segment 10, which is illustrated in FIG. 2, from the viewing direction denoted by IV in correspondence with a further, third exemplifying embodiment of the invention. In this exemplifying embodiment chambers 37 and 37' are formed and shaped by stiffening ribs 20, 35, 36 and 20'. In that case the chambers 37 and 37' are bounded by sections 41 and 41' of the outer shell 12 or cover layer 12. In addition, the sections 41 and 41' represent the outer walls or tops or top walls or upper boundaries for the chambers 37 and 37'. Guide flutes 40 and 40' or guide grooves 40 and 40' which are aligned or oriented in running direction are provided in the region of these sections 41 and 41'. A roller or guiding roller or roller arrangement of two flanges or lateral guides can engage in the guide flutes 40 and 40' or guide grooves 40 and 40' in order to support and/or guide the handrail 1 in the lower region 3 or return run 3, as is illustrated in FIG. 1 by way of the roller arrangement 6A to 6H.

Moreover, a chain element 26 of the chain is illustrated in FIG. 4. The bearing pins 25 and 25' or mounts 25 and 25' or recesses 25, 25' engage or clip in the chain element 26 or permanently mount it.

Figure 5:
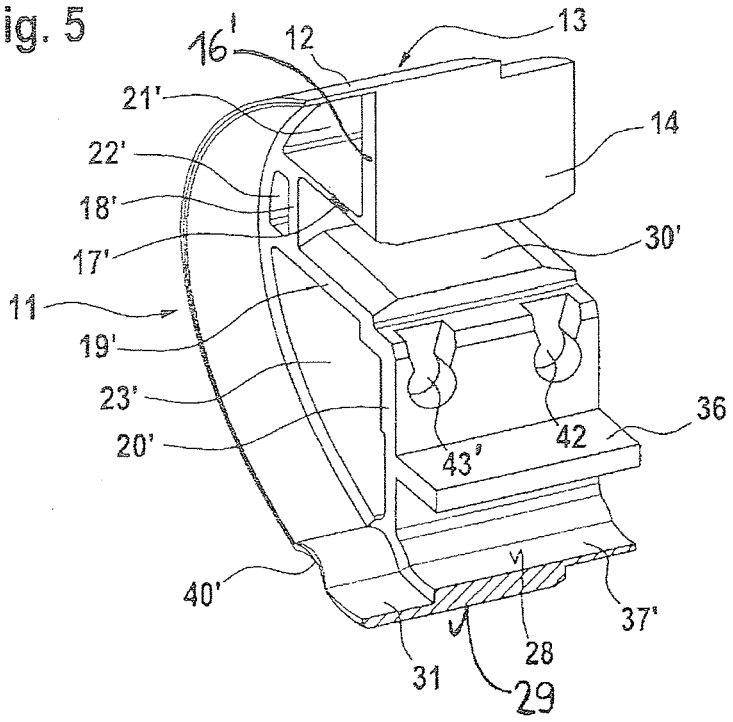

FIG. 5 shows a sectional illustration of a grip element 10 or grip segment 10 in a perspective view in correspondence with a further embodiment of the invention. In this exemplifying embodiment bearing recesses 42 and 43 serving as bearing location or mounting location are formed at the stiffening rib 20'. Corresponding bearing recesses 42 and 43' or mounts 42 and 43' or positioning points 42 and 43' are also formed in the opposite stiffening rib 20, which lies opposite the stiffening rib 20' as illustrated, for example, by way of FIG. 4. Pins or longitudinal pins of a chain element 26 can engage in the bearing recesses 42 and 43' or mounts 42 and 43' or positioning points 42 and 43'. A customary standard pin 26' of a chain element 26 is illustrated in FIG. 4. This standard pin 26' is then pushed into the stiffening ribs 20, 20' at both sides so that it engages or detents or clips at both sides in bearing recesses 42 and 43' or mounts 42 and 43' or positioning points 42 and 43'. The spacing between the bearing recesses 42 and 43' or mounts 42 and 43' or positioning points 42 and 43' of the stiffening rib 20' corresponds exactly with the spacing of the pins of the chain element 26. The chain or the belt thus detents in the provided or corresponding bearing recesses 42 and 43' or mounts 42 and 43' or positioning points 42 and 43' in the stiffening ribs 20 and 20'.

Figure 6:
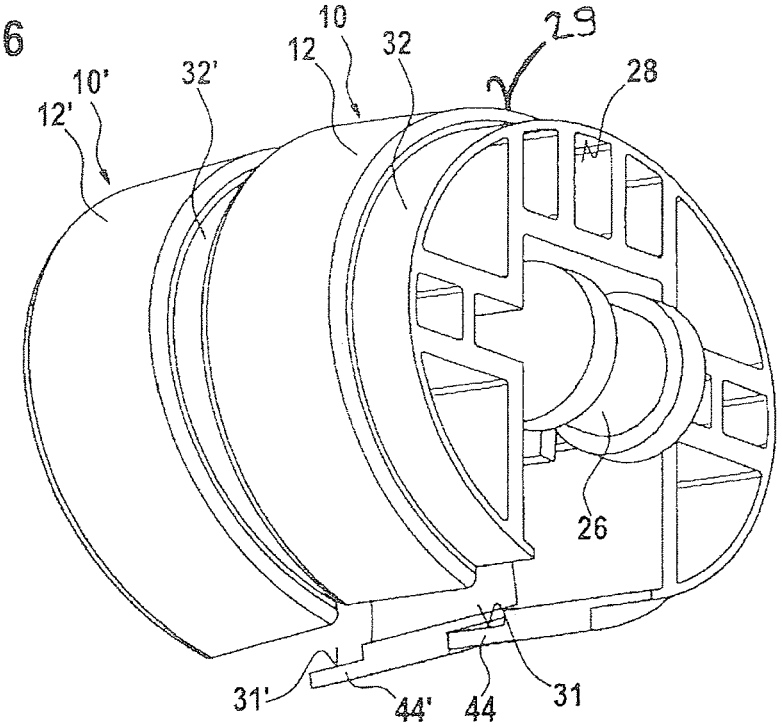

FIG. 6 shows two grip elements 10 and 10' or grip segments 10 and 10', which are placed together in correspondence with an assembly of the handrail 1, for further explanation of the invention. In this regard it can be seen or is clarified how a narrow collar 44 of the outer shell 12 or cover layer 12 of the grip element 10 or grip segment 10, which is formed by the encircling, inwardly disposed recess 31 or cut-out 31, fits in or enters into the recess 32' of the outer shell 12' or the cover layer 12' of the adjacent grip element 10' or grip segment 10'. The adjacent grip element or grip segment 10' similarly has a narrow collar 44' or cover strip 44' or cover clip 44', which is formed by an encircling, inwardly disposed cut-out 31' or recess 31'. The handrail 1 can thereby be constructed or produced from a plurality of grip elements or grip segments which are made or designed in correspondence with the grip element or grip segment 10. Specifically, it is possible for the handrail 1 is formed from a plurality of grip elements or grip segments which are all identical or of the same construction or manufacture. However, it is also possible to construct the handrail 1 from grip elements or grip segments of different shapes or made of different materials. The further design of the grip element 10 or grip segment 10 illustrated in FIG. 6 corresponds with that illustrated in FIG. 3 or FIG. 4. Consequently, for simplification of the illustration a repeated identification of already described elements is dispensed with.

FIG. 7 shows a grip element 10 or grip segment 10 from the viewing direction denoted by IV in FIG. 2 in correspondence with a further exemplifying embodiment of the invention. In that case the outer shell 12 or cover layer 12 has a cross-section which is composed of a small oval or elliptical contour 50 and a large oval or elliptical contour 51. In that regard the small oval or elliptical contour 50 is placed at the large oval or elliptical contour 51 at one side 52 of the large oval or elliptical contour 51 and cut by the large oval or elliptical contour 51. The small oval or elliptical contour 50 is then so oriented with respect to the large oval or elliptical contour 51 that the two contours 50, 51 have coincident or approximately coincident longitudinal axes 53. Moreover, the grip element 10 or grip segment 10 is pushed onto or attached on a handrail profile member 4, which is connected with or plugged, pressed or forced onto a balustrade 5. The balustrade 5 can, for example, be formed from glass or safety glass. The handrail profile member 4 can be formed from steel or stainless steel, from aluminium, from a plastics material or a material compound or the like. Specifically, the handrail guide profile member 4 can be formed in longitudinal straight regions as fibre-reinforced synthetic material. The thermal expansion of the handrail profile member 4 can thereby be reduced. In the short curve region or deflecting region the handrail profile member 4 can be formed specifically from an abrasion-resistant synthetic material without reinforcing or from steel or stainless steel or aluminium or from a material pairing or material compound (steel/plastics material, stainless steel/plastics material, aluminium/plastics material).

The grip element 10 or grip segment 10 is strengthened in the region of the small oval or elliptical contour 50 by further stiffening ribs, which again form further chambers. For simplification of the illustration only the additional stiffening rib 54 and the new, further chamber 55 are characterised.

A handrail 1 can be assembled in any desired length from a plurality of grip elements 10 or grip segments 10 which can be constructed in accordance with any one of the described exemplifying embodiments. An advantageous sound damping, noise insulation and the like are, inter glia, thereby possible through the shell shape with the outer shell 12 or cover layer 12 and the chambers 21 to 23 and 27 and 38 as well as 55. The individual grip elements 10 or grip segments 10 can in that case each be of integral or multi-part construction. For example, the grip elements 10 or grip segments 10 can be constructed by injection-moulding, press-moulding, casting or extruding or pultrusion or diecasting. In that case a large opening 14 enabling easy, simple assembly on the traction means can be made possible. Moreover, the very large handrail guide profile member 4 is received exactly and precisely by the grip element 10 or grip segment 10. One or more guide flutes 40 and/or 40' are in that case preferably so arranged that these are provided opposite the opening 14 at the outer shell 12 or cover layer 12. In the case of possible, provided bearing pins 25 and 25' or mounts 25 and 25' or recesses 25 and 25' the grip element 10 or grip segment 10 can then be held between the traction means, in particular the chain or transport chain, and the rollers or guide rollers of the rollers 6A-6H. The guide flutes 40 and 40' enable presetting of a defined track or guide so that operation of the escalator or moving walkway free of disturbance is achieved.

The grip element 10 or grip segment 10 can comprise an outer shell 12 or a cover layer 12 adapted to the respectively required application. Specifically, the outer shell 12 or cover layer 12 can have an oval or elliptical cross-section which makes possible a pleasant grip, as well as improved haptics and damping. Moreover, the outer shell 12 or cover layer 12 can also be composed of several materials as well as contours, for example of two oval or elliptical contours 50 and 51, as is described by way of FIG. 7. Holding or gripping from below can also thereby be made possible, so that a secure and better retention or holding at the handrail 1 is made possible for children and young people. In advantageous manner the handrail 1 can be composed of nothing but the same elements or same parts, so that assembly takes place rapidly and quickly. The same elements or grip elements 10 or grip segments 10 of the same construction with expensive, luxurious special segments are additionally possible and conceivable. By virtue of the large or largest possible width of the handrail guide profile member 4 a good stiffness in twisting or torsional stiffness of the segments 10 in the forward run region 2 is additionally guaranteed. Furthermore, a high bending stiffness in outward direction is achieved. Moreover, a central guidance, as is illustrated by way of FIGS. 3, 4 and 5, can be made possible. This central guidance or handrail guidance can achieve a low wear especially in the idle run. In addition, this central guidance brings more stability and a central introduction of force for the handrail 1. Moreover, the traction means in the case of a central guidance can engage centrally and move the grip elements 10 or grip segments 10 free of friction. Beyond that, it is possible in the return run region 3 to replace or exchange in very easy and simple manner individual grip elements 10 or grip segments 10 of the handrail 1 in the event of possible damage.

Figure 8:
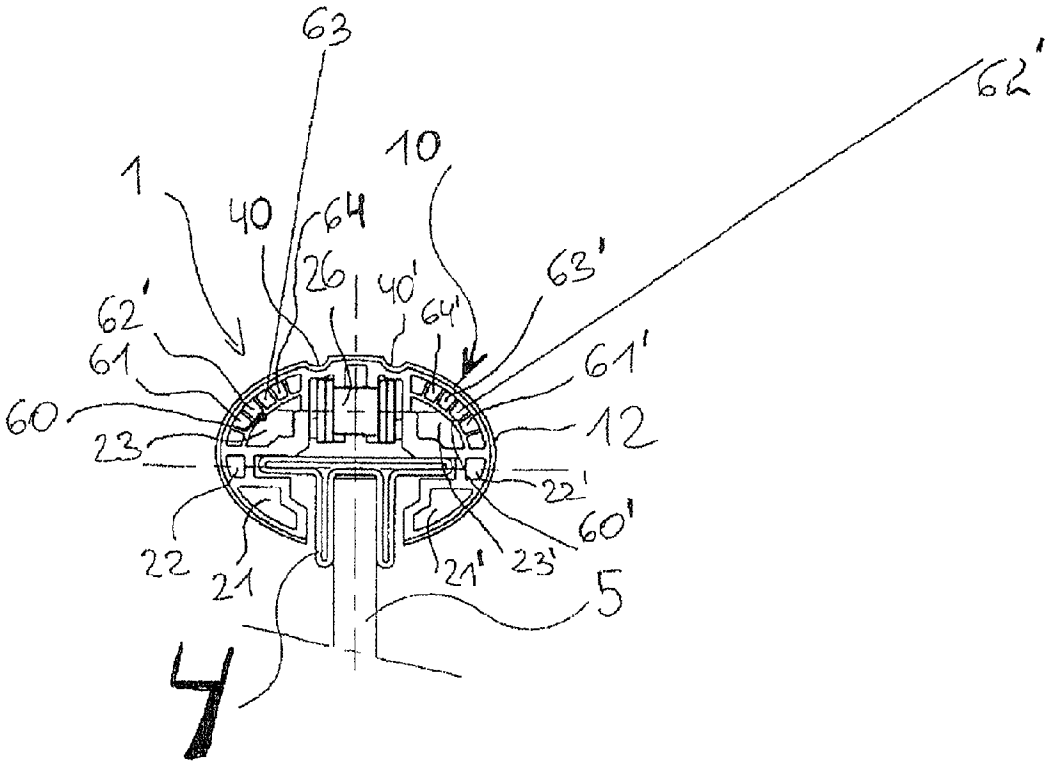

FIG. 8 shows a grip element 10 or grip segment 10 in a further exemplifying embodiment of the invention. In that case the chamber 23 and 23' is still further subdivided. The chamber 23 and 23' is segmented by the web 60 and by the web 60' into subchambers. The new, enlarged subchambers 61, 62, 63 and 64 as well as 61', 62', 63', 64' resulting therefrom are bounded by the outer shell 12 or cover layer 12 and by the web 60 and 60'. A subdivision and/or bounding of the chambers 23, 62, 62, 63 is given by the chambers. The chambers 61, 62, 63 and 64 produce a reinforcement and/or double reinforcement and/or double-walling of the grip element 10 or grip segment 10, whereby an additional stiffening of the grip element 10 or grip segment 10 is given. Moreover, excellent or outstanding sound damping as well as noise insulation is given and the thermal insulation is strikingly or significantly improved. The sound insulation and/or noise isolation is or are further increased by filling the chambers 61, 62, 63 and 64 by a damping material. Polyurethane foams, adhesives, sealants, polystyrol, gypsum, elastomers, TPE, TPU, natural-fibre composites, GF-polyamide silicon, metal foams, rubber, etc., are suitable for filling the chambers 61, 62, 63 and 64.

Also particularly suitable or preferred for the filing or part filling of the chambers 61, 62, 63 and 64 with insulation materials are, for example: glass wool, mineral wool, glass-fibre, natural fibre, wood wool, acryl fibres, synthetic-resin press-moulded wood, synthetic-material press-moulded cement, natural-fibre composite, fibre composite acryl or polyamide, Styropor cement, polystyrol, PUR insulating foam, PU foam, etc. Through this addition of thermal insulating material the grip elements 10 or grip segments 10 are thermally insulated particularly satisfactorily and safeguarded or protected against freezing on or freezing in place and thereby very suitable for outside installation of the escalator or moving walkway. The grip element 10 or grip segment 10, by virtue of the filling or filling up with thermal insulating material, can no longer freeze to the handrail guide profile member 4 and is thus suitable and envisaged for more rigorous use or escalator use and lower temperatures as well as temperatures below the freezing point.

Figure 9:
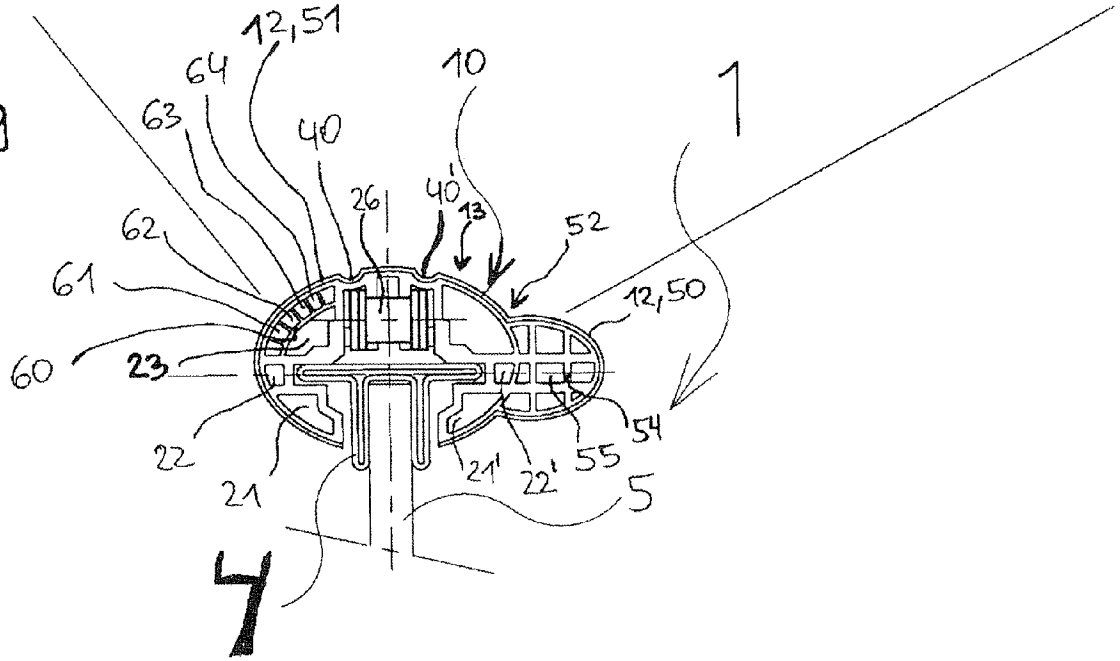

FIG. 9 shows a grip element 10 or grip segment 10 in a further exemplifying embodiment. FIG. 9 is constructed like the grip element 10 or grip segment 10 as described in FIG. 7 only with the addition of the reinforcing and/or double-reinforcing and/or double-walling by means of enlarged chambers. In the case of this embodiment as well the chamber 23 is additionally subdivided and is segmented or halved or divided or subdivided by the web 60. The new chambers 61, 62, 63 and 64 are formed as a consequence or result thereof. A subdivision and/or bounding of the chambers 61, 62, 63 and 64 is provided by web 60. An additional or enhanced stiffening of the grip element 10 or grip segment 10 is given and produced to noticeable extent. Furthermore, the same improved characteristics apply to the grip element 10 or grip segment 10 of FIG. 9 as described in FIG. 8. Thus, an improved sound insulation and noise isolation and thermal insulation are given. Additional fillings of the chambers as described in FIG. 8 are equally possible. The properties of the grip element 10 or grip segment 10 are thereby subject to further or extra or additional increase.

Moreover, the invention is not restricted to the described exemplifying embodiments.

The invention claimed is:

1. A handrail, comprising a plurality of sequential grip segments, at least one of the grip segments comprising a base body having an outer shell, the base body having an interior space bounded by the outer shell with a plurality of chambers separated from one another by stiffening ribs arranged in the interior space, the stiffening ribs forming a first lateral guide groove and a second lateral guide groove that face each another, each of the first and second lateral guide grooves being completely spaced from the outer shell by at least one of the chambers formed by the stiffening ribs, wherein the base body is of integral construction and has at least one bearing support for direct clipping in engagement with a mating portion of a traction means.

2. The handrail according to claim 1, wherein the chambers are at least partially filled.

3. The handrail according to claim 2, wherein the plurality of chambers are further subdivided into subchambers.

4. The handrail according to claim 1, wherein the at least one bearing support is connected to an inner side of the outer shell.

5. The handrail according to claim 1, wherein the at least one bearing support is in the form of a recess and is provided at at least one of the stiffening ribs.

6. The handrail according to claim 1, further comprising at least one guide flute oriented in a running direction is located at an outer side of the outer shell.

7. The handrail according to claim 1, wherein the outer shell has a cross-section composed at least in a grip region of two intersecting oval or elliptical contours, one of the contours being larger than the other.

8. The handrail according to claim 7, wherein longitudinal axes of the elliptical contours are coincident.

9. The handrail according to claim 1, wherein at least one of the grip segments and the base body is constructed with a web.

10. The handrail according to claim 1, wherein the base body of at least one of the grip segments is constructed with at least double walling.

11. The handrail according to claim 2, wherein the chambers are at least partly filled with at least one of a damping material, an insulating material, a sealing material, an adhesive material or a thermal insulating material.

12. A person conveying device having the handrail according to claim 1.

* * * * *